US006168453B1

(12) United States Patent
Kuo

(10) Patent No.: US 6,168,453 B1
(45) Date of Patent: Jan. 2, 2001

(54) LATCH MECHANISM FOR ENGAGING ELECTRICAL CONNECTORS

(75) Inventor: Peter Kuo, Chung-Ho (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/418,668

(22) Filed: Oct. 14, 1999

(30) Foreign Application Priority Data

Nov. 3, 1998 (TW) ..... 87218244

(51) Int. Cl.[7] ..... H01R 13/627

(52) U.S. Cl. ..... 439/357

(58) Field of Search ..... 439/353, 357, 439/358

(56) References Cited

U.S. PATENT DOCUMENTS 5,599,207 * 2/1997 Lai ..... 439/357
5,727,970 * 3/1998 Koguchi et al. ..... 439/358
5,788,528 * 8/1998 Orr, Jr. et al. ..... 439/358
5,848,456 * 12/1998 Sjoqvist ..... 439/358

* cited by examiner

*Primary Examiner*—Gary F. Paumen
(74) *Attorney, Agent, or Firm*—Wei Te Chung

(57) ABSTRACT

A latch mechanism for firmly engaging a first connector and a second connector includes a fixing plate with a linking portion perpendicularly extending therefrom, a pair of extending portions perpendicular to the fixing plate, and a locking portion downwardly extending from the linking portion. Grasp arms downwardly extend from ends of the extending portions for engaging the first connector. The locking portion is firmly inserted into the first connector to form a reliable connection therewith. The fixing plate is securely retained in the second connector whereby the first and second connectors are firmly engaged.

3 Claims, 4 Drawing Sheets

LATCH MECHANISM FOR ENGAGING ELECTRICAL CONNECTORS

BACKGROUND OF THE INVENTION

1. Field of the Invention

The present invention relates to a latch mechanism, and particularly to a latch mechanism for engaging two electrical connectors.

2. Prior Art

As computer technology advances, an increasing number of computer peripherals are connected to a computer host for performing various kinds of applications. The peripherals interface with the host computer via electrical connectors by adapting one of two commonly employed engaging methods.

In the first method, shown in FIG. 1, a resilient metal engaging portion 6 comprising a convex head is pivotably attached to an engaging end of a connector 5. A mating connector 7 for engaging with the connector 5 equips a laterally extending metal sheet 71 with a clasping concave 72. When the connectors 5, 7 are engaged, the engaging portion 6 is pivoted toward the mating connector 7 until the convex head 61 engages with the clasping concave 72. The connectors 5, 7 are further connected together by means of a screw 4. However, since significant clearance must exist on opposite ends of the mating connector 7 to permit pivoting of the engaging portions 6, space is not efficiently utilized. Furthermore, the provision of the screws 4 makes the assembly process laborious.

FIG. 2 illustrates the second method for engaging a connector 9 to a mating connector 8. The mating connector 8 defines a hole 81 in opposite ends thereof for extension of a bolt 82 therethrough. The connector 9 defines corresponding screw holes 91 therein for threadingly engaging with the corresponding bolt 82. Thus, the connectors 8, 9 are securely engaged. However, the provision of the bolts 82 doesn't simplify the assembly process.

Hence, a method for engaging electrical connectors is requisite for overcoming the disadvantages of the prior art.

SUMMARY OF THE INVENTION

An object, therefore, of the invention is to provide latch mechanism for engaging electrical connectors which is easily assembled between the connectors and which promotes an efficient use of space within a computer.

In accordance with a preferred embodiment of the present invention, a first connector and a second connector are engaged by a latch mechanism. The first connector includes a dielectric housing defining a plurality of terminals receiving passages therethrough and a pair of socket holes in opposite end portions thereof. The second connector includes a dielectric housing defining a plurality of terminal receiving passages therethrough, and a pair of bases extending from opposite ends of the housing. Each base forms a forwardly extending elastic arm with a locking protrusion formed on an end thereof. The latch mechanism comprises a fixing plate, a linking portion, a pair of extending portions and a locking portion, The extending portions and the locking portion both extend from the linking portion. The locking portion is inserted into and locked in the screw hole of the housing. Furthermore, the locking portion is configured to have an inverse V-shaped slot thereby forming a pair of resilient legs having a plurality of barbs for strengthening the connection between the latch mechanism and the first connector. An aperture is defined in the fixing plate of the latching mechanism for securely engaging the locking protrusion of the corresponding base. Thus, the first and second connectors are securely engaged together by means of the latch mechanism.

Other objects, features and advantages will be apparent from the following detailed description taken in connection with the accompanying drawings.

DETAILED DESCRIPTION OF THE INVENTION

Figure 1:
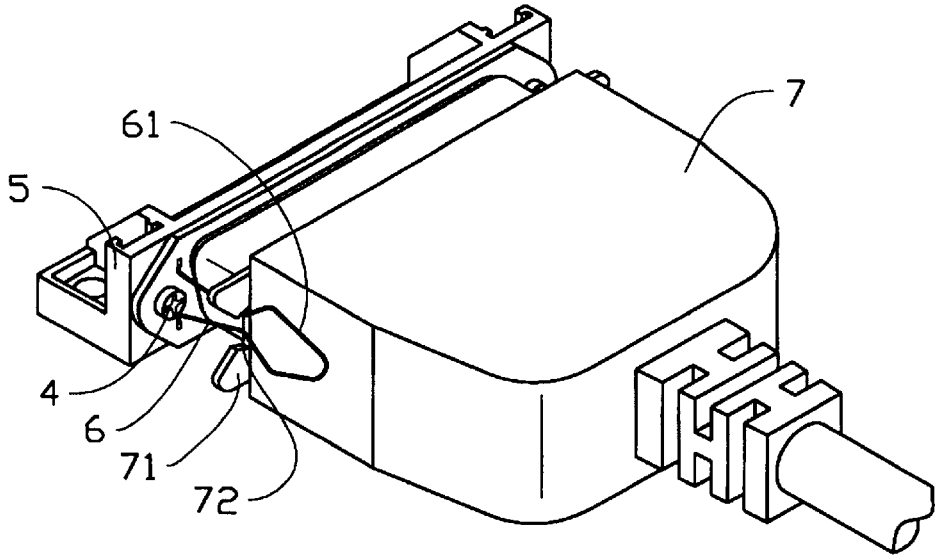
FIG. 1 (PRIOR ART)
FIG. 1 is a perspective view of a latch mechanism of a conventional electrical connector.
Figure 2:
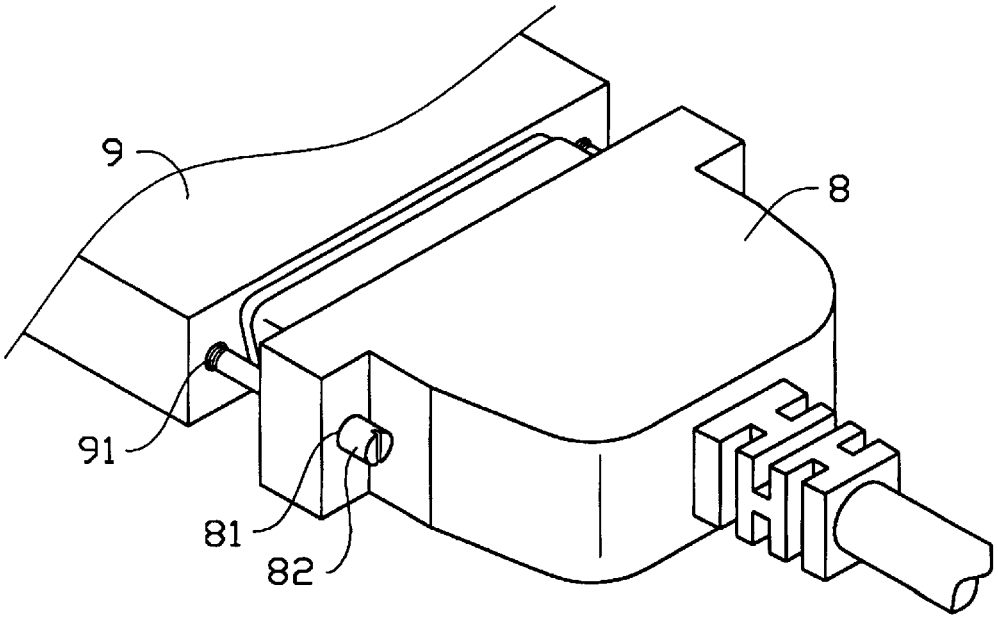
FIG. 2 (PRIOR ART)
FIG. 2 is a perspective view of a latch mechanism of another conventional electrical connector.
Figure 3A:
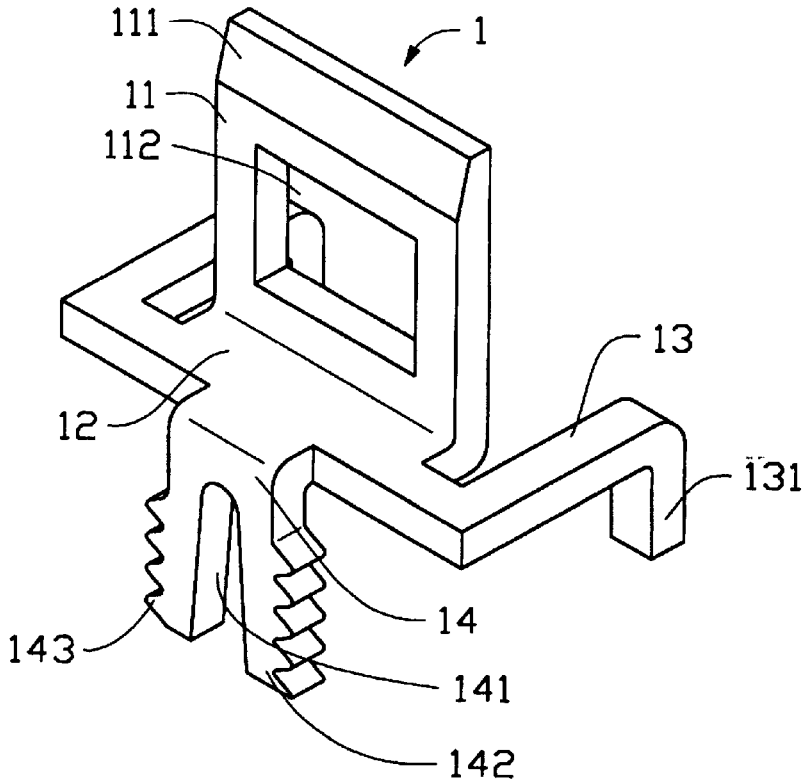
FIG. 3A is a perspective view of a latch mechanism in accordance with the present invention.
Figure 3B:
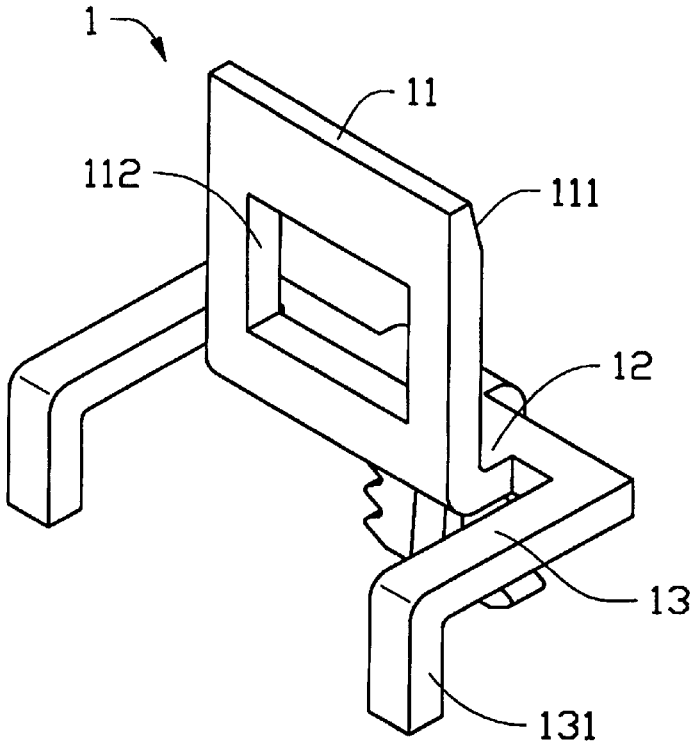
FIG. 3B is a view similar to FIG. 3A taken from-a different angle.
Figure 6:
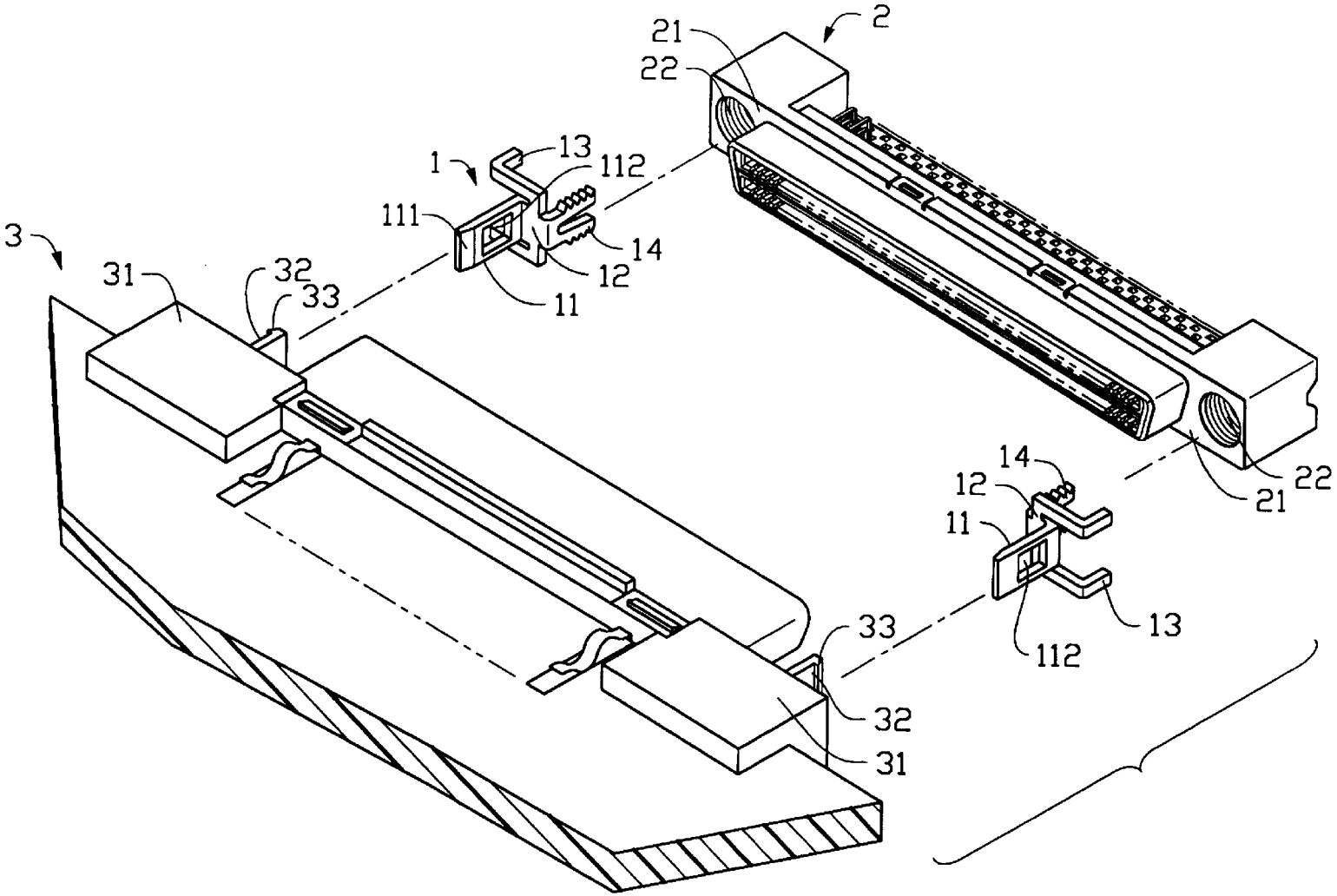
FIG. 6 is an exploded view of the latch mechanism and two electrical connectors to be engaged thereby.

With reference to FIGS. 3A, 3B and 6, a latch mechanism 1 for firmly engaging a first connector 2 to a second connector 3, comprises a fixing plate 11 with a linking portion 12 perpendicularly extending therefrom, a pair of extending portions 13 and a locking portion 14. The extending portions 13 and the locking portion 14 both extend from the linking portion 12.

The fixing plate 11 defines an aperture 112 therein and forms an inclined guiding face 111 for facilitating connection to the second connector 3. The linking portion 12 is perpendicular to the fixing plate 11 and the extending portions 13 extend from opposite ends of the linking portion 12. A grasping arm 131 perpendicularly extends from each extending portion 13 for engaging the first connector 2. The locking portion 14 downwardly extends from the linking portion 12. The locking portion 14 has an inverse V-shaped slot 141 thereby forming a pair of resilient legs 142 having a plurality of barbs 143 formed on outer sides thereof.

Figure 4:
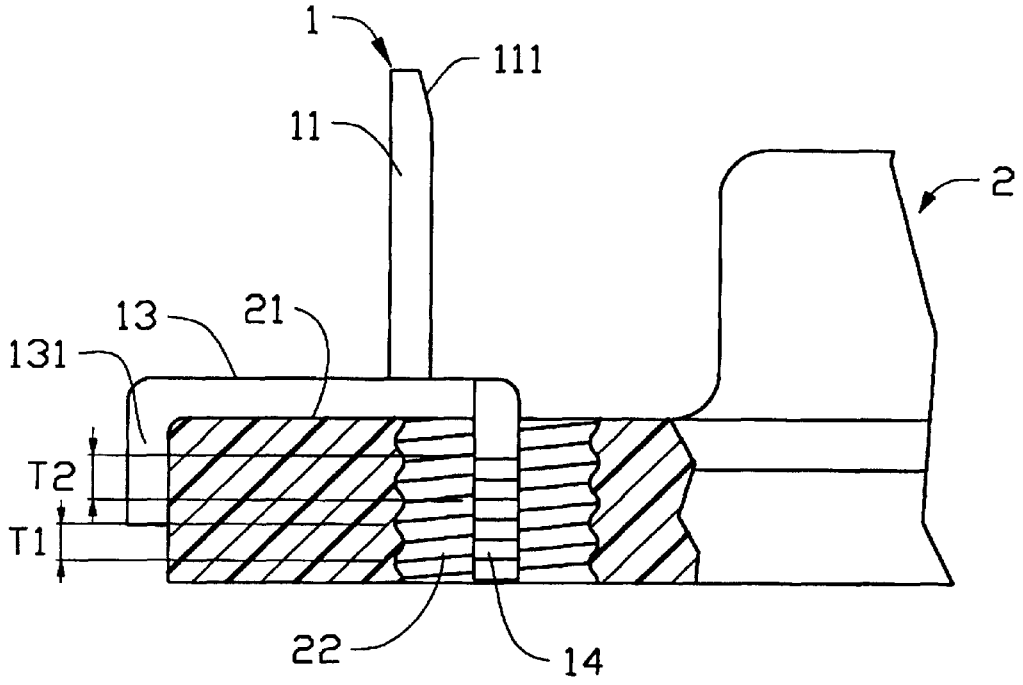
FIG. 4 is a partial, cross sectional view of the latch mechanism mounted to a first connector.
Figure 5:
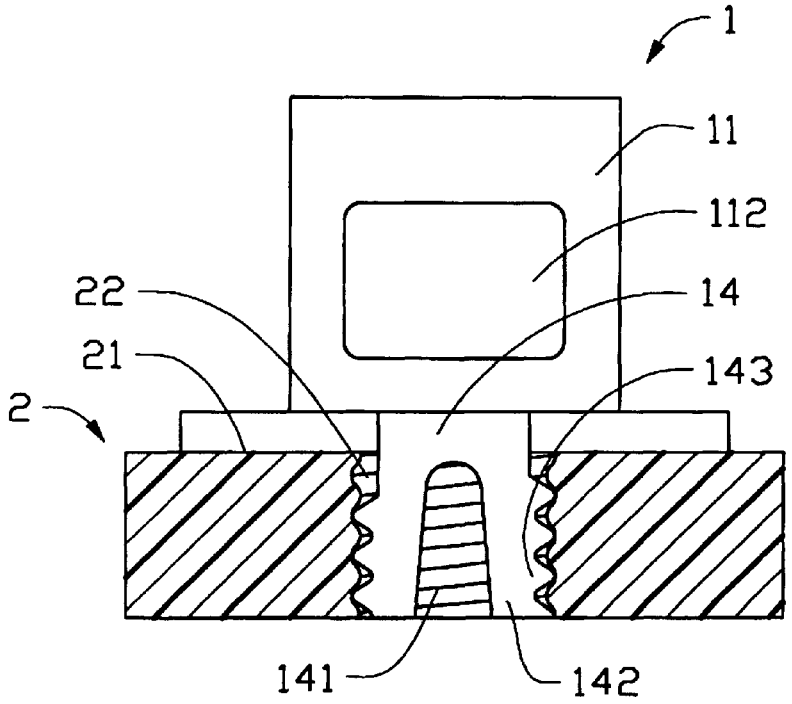
FIG. 5 is a view similar to FIG. 4 taken along a different cross sectional line.

With reference to FIG.4, a pair of screw holes 22 is defined through opposite end portions 21 of the first connector 2. The depth of each screw hole 22 is substantially equal to the length of the locking portion 14 of the latch mechanism 1. A screw pitch T1 of the screw hole 22 is wider than a pitch T2 between the barbs 143 of the legs 142 thereby facilitating a secure interconnection between the locking portion 14 and the screw hole 22 of the first connector 2. In FIG.5, to engage the latch mechanism 1 with the first connector 2, the linking portion 12 and the extending portions 13 firmly abut against the surface of the end portions 21 of the first connector 2, and the locking portion 14 is inserted into the screw hole 22. Since the length of the extending portions 13 is substantially the same as the distance from the screw hole 22 to a lateral face of the first connector 2, the grasping arms 131 will firmly abut against the lateral face of the first connector 2. Furthermore, since the pitch T2 between barbs 143 of the legs 142 is slightly smaller than or equal to the screw pitch T1 of the screw hole 22, the barbs 143 can be firmly engaged within the screw hole 22, and the legs 142 are imbedded in the inner wall of the screw hole 22 to provide a firm and reliable connecting force.

As shown in FIG. 6, the latch mechanism 1 of invention engages with the first connector 2 and further connects with the second connector 3. The second connector 3 forms a pair of bases 31 on opposite sides thereof. Each base 31 has a forwardly extending elastic arm 32 with a locking protrusion 33 formed on an end thereof. In assembly, the latch mechanism 1 is fit into the corresponding screw hole of the first connector 2. The aperture 112 of the fixing plate 11 engages with the locking protrusion 33 of the corresponding elastic arm 32 of the second connector 3. Thus, the first connector 2 is securely attached to the second connector 3 and disconnection of the two connectors 2, 3 is prevented.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric housing defining a plurality of terminal receiving passages therethrough and a pair of screw holes in opposite ends thereof;

a plurality of terminals received in said passages; and two latch mechanisms each comprising a fixing plate with a linking portion extending therefrom, a pair of extending portions on opposite ends of the linking portion, and a locking portion in the respective hole of said housing, the extending portions firmly abutting a respective side of said dielectric housing;

wherein a length of each extending portion is substantially equal to a distance from a center line of the screw hole to the respective side of the housing;

wherein said fixing plate of the latch mechanism defines an aperture therein;

wherein said linking portion is perpendicular to said fixing plate;

wherein said locking portion comprises two resilient legs for facilitating engagement with the housing;

wherein each resilient leg has a plurality of barbs thereon.

2. A latch mechanism for engaging two mating connectors, comprising:

a fixing plate with a linking portion extending therefrom defining an aperture therein;

a pair of extending portions perpendicular to said fixing plate; and a locking portion extending downwardly from said linking portion thereon, said locking portion in interferece fit with a housing of one of the connectors and said extending portions engaging a lateral side of said housing of said connector cooperatively;

wherein said fixing plate has an inclined guiding face for facilitating engagement with the other of the connectors;

wherein said locking portion perpendicularly extends from said linking portion;

wherein said locking portion comprises two resilient legs for facilitating engagement with the housing;

wherein each resilient leg has a plurality of barbs thereon.

3. A pair of engaged connectors comprising:

a first connector including a dielectric housing defining a plurality of terminals receiving passages therethrough and a pair of screw holes in opposite end portions thereof;

a second connector including a dielectric housing defining a plurality of terminals receiving passages therethrough and forming a pair of bases on opposite sides thereof, each base having a forwardly extending elastic arm with a locking portion formed on an end thereof, the bases being positioned in opposition to the screw holes of the first connector; and a latch mechanism being mounted in each screw hole of said first connector and further connected to the respective locking portion of said second connector, comprising a fixing plate with a linking portion extending therefrom, a pair of extending portions projecting from opposite ends of the linking portion and defining a gap therebetween, and a locking portion, the locking portion being inserted and retained in the respective screw hole of said housing and the extending portions firmly abutting a respective side of said dielectric housing;

wherein the length of the extending portions are substantially equal to the distance from the screw hole to the respective side of said housing of said first connector;

wherein the locking portion includes a pair of resilient legs having barbs formed on outer sides thereof;

wherein the pitch of adjacent barbs of said resilient legs is smaller than the screw pitch of said screw hole;

wherein an inverse V-shaped aperture is formed between the elastic legs for providing elasticity and facilitating a stable connection between said latch mechanism and the respective connector.

* * * * *